US006807840B2

(12) United States Patent
Wilhelm et al.

(10) Patent No.: US 6,807,840 B2
(45) Date of Patent: Oct. 26, 2004

(54) CRIMPING PLIERS WITH ADJUSTABLE CRIMPING GAUGE

(75) Inventors: Edgar Wilhelm, Altersbach (DE); Horst Hofmann, Unterschönau (DE)

(73) Assignee: Rennsteig Werkzeuge GmbH, Viernau/Thuringen (DE)

( * ) Notice: Subject to any disclaimer, the term of this patent is extended or adjusted under 35 U.S.C. 154(b) by 0 days.

(21) Appl. No.: 10/042,726

(22) Filed: Jun. 27, 2002

(65) Prior Publication Data

US 2004/0000183 A1 Jan. 1, 2004

(51) Int. Cl.[7] ..... B21D 39/00
(52) U.S. Cl. ..... 72/402; 72/409.1
(58) Field of Search ..... 72/709.01–709.19, 72/402; 81/355, 356, 395

(56) References Cited

U.S. PATENT DOCUMENTS 2,753,742 A * 7/1956 Buchanan ..... 72/402
3,028,776 A * 4/1962 Keller et al. ..... 72/402
3,094,702 A * 6/1963 Ustin et al. ..... 72/402
3,199,335 A * 8/1965 Holmes et al. ..... 72/409.01
3,226,968 A * 1/1966 Holmes ..... 72/402
3,459,029 A * 8/1969 Rosenfeld ..... 72/402
3,750,618 A * 8/1973 Griebenow ..... 116/231

* cited by examiner

*Primary Examiner*—Lowell A. Larson
(74) *Attorney, Agent, or Firm*—Collard & Roe, P.C.

(57) ABSTRACT

A crimping pliers has a movable plier leg coupled to a fixed plier leg and a curved body in a head part of the pliers. Movable crimping punches are located in a pivoting plunger which is enclosed in the curved body. An adjusting and setting device having a threaded bush, a threaded spindle, a setting wheel, a fine scale and a rough scale is located on the fixed plier leg. The adjusting and setting device pivots the curved body allowing precise adjustment of the crimping punches via control cams in the curved body.

3 Claims, 2 Drawing Sheets

CRIMPING PLIERS WITH ADJUSTABLE CRIMPING GAUGE

BACKGROUND OF THE INVENTION

1. Field of the Invention

The invention relates to crimping pliers with an adjustable crimping gauge, in connection with which the crimping punches acting on the crimping contacts can be driven into and out of the crimping position by a pivoting plunger. This plunger guides the crimping punches and is actuated by the movable handle of the pliers and is guided in a curved body.

2. Prior Art

Crimping pliers of this type, i.e. those in connection with which the crimping punches for crimping contact pins and/or contact bushes are arranged in a pivoting plunger that is arranged in the head part of the pliers with rotational or pivoting mobility, and driven into the crimping position by a curved body enclosing the crimping punches in a guiding manner, require for each punch a gauge for adjusting the crimping measurement desired or required in the given case, such measurement depending on the cross section of the conductor. Such a gauge, which is usually provided in the form of an adjusting mandrel, has to be made available in this connection for all adjustment measurements of the crimping mandrels. This means that an arsenal of gauge mandrels has to be kept available for each pair of crimping pliers, so that the pliers can be adjusted and set to the desired crimping measurement with the required accuracy to gauge.

This is costly, on the one hand, and also not useful, on the other, because the work with and the handling of such tools is complicated, will easily lead to errors, and, furthermore, requires that the work is carried out with great carefulness.

Setting and adjusting devices in the form of set screws and/or lever elements have already been provided on the crimping pliers of the type that are known in the market and considered here as well, which are the so-called four-mandrel crimping pliers. The curved body, which is provided with control cams, can be relatively pivoted with the help of such screws or lever elements in order to determine and adjust in this way the setting and work path of the crimping punches.

Such setting and adjusting devices do not work in a satisfactory manner for the high requirements currently to be met in the industry using such tools because it is difficult and costly to realize with such devices an exactly dimensioned crimping measurement.

SUMMARY OF THE INVENTION

The purpose and the technical problem of the present invention result from the circumstances outlined above.

The purpose is to simplify the adjustment and setting of the pair of crimping pliers to the given required crimping measurement under the handling aspect, and, furthermore, to save those costs that are incurred when a great number of adjusting mandrels have to be made available.

The invention is based on the problem of employing on the pair of crimping pliers an adjusting and setting device using only one gauge mandrel that permits the crimping rate to be adjusted for any size of contacts with high accuracy, i.e. down to a unit of measurement of one hundredth part of a millimeter (1/100), so that the higher crimping accuracy increasingly required predominantly in the field of electronics can be assured.

This problem is solved according to the invention with the technical means disclosed herein whereby useful special features are also explained.

Versus the known and currently practiced state of the art in the field of cable crimping with the help of crimping pliers, in particular of the type employing the four-mandrel principle, the technical solution as defined by the invention offers welcome benefits because it has not been possible heretofore to realize the desired pressing or crimping process for contact pins and contact bushes with the aforementioned adjustment accuracy of 1/100 mm.

The means of the adjusting and setting means, which are employed in a useful manner, as well as their very simple handling in the practical application by the user, speak for itself with respect to the perfection of the functional properties of use of such crimping pliers achieved with the proposal according to the present invention.

BRIEF DESCRIPTION OF THE DRAWINGS

The invention is briefly explained in the following in detail with the help of an exemplified embodiment. In the associated drawing.

DETAILED DESCRIPTION OF THE INVENTION

Figure 1:
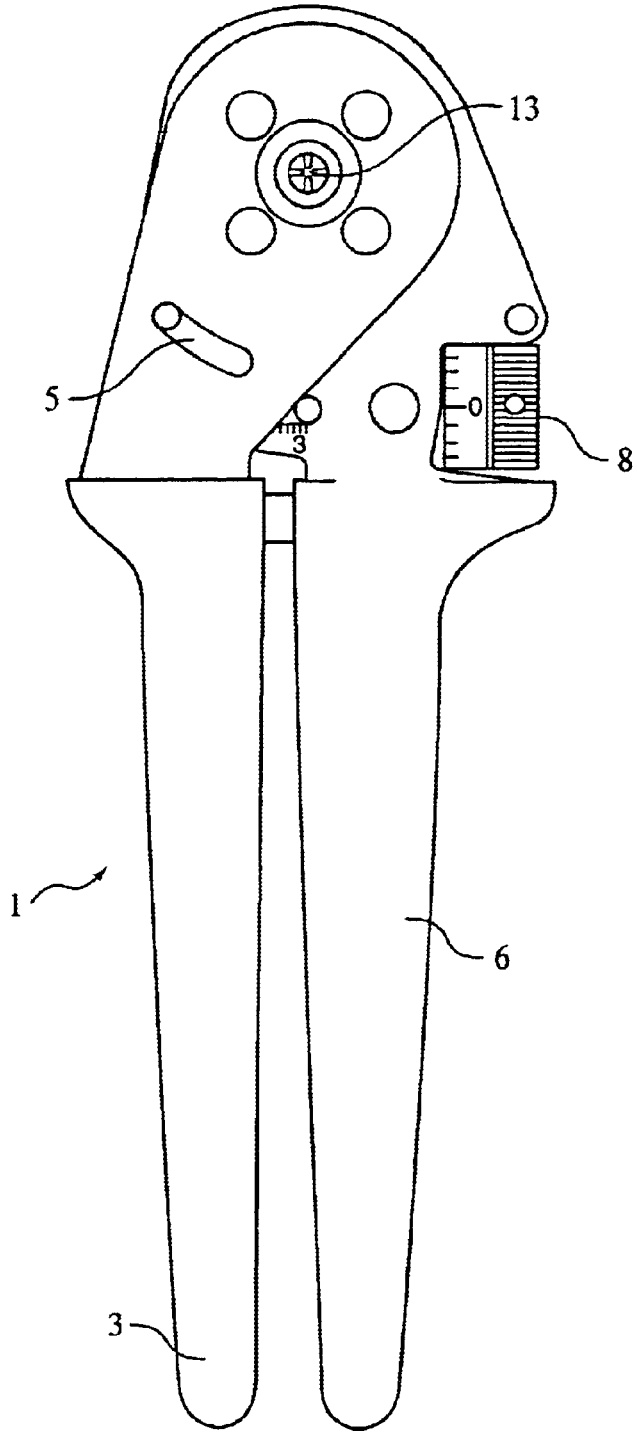
FIG. 1 shows the front view of a four-mandrel pair of pliers in the closed condition.

The crimping pliers 1 with the adjusting and setting device 2 installed according to the invention, is comprised of a movable pliers leg 3 with the pivoting plunger 4 and the usually fitted, not shown ratchet for controlling the closure of the pliers, as well as an opening limitation 5, and a fixed pliers leg 6, on which the adjusting and setting device 2 is installed in a fixed manner.

The adjusting and setting device 2 is comprised of the threaded spindle 7 with the setting wheel 8, and is connected by a threaded bush 9 with an arm component 11 associated with the curved body 10, in a manner such that when the setting wheel 8 is rotated via the threaded spindle 7, the curved body 10 is pivoted in the one or other direction in relation to the pivoting plunger 4.

Due to the pivotal movements, the control cams 12 of the curved body 10, which each are designed with the same pitch, a correspondingly dimensioned work path is made available for the crimping punches 13 at the same opening angle of each of the pliers legs 3 and 6. This makes it possible to realize differently dimensioned crimping depths according to the adjustment rates in the given case.

Figure 2:
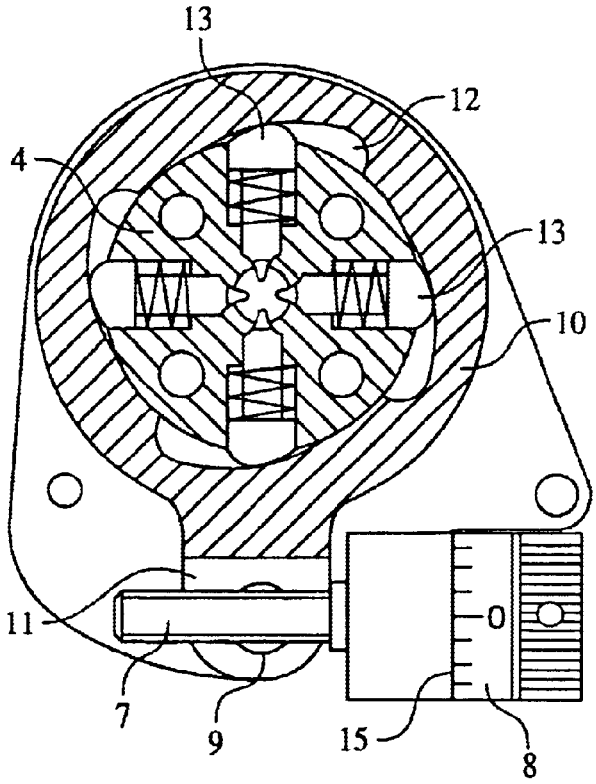
FIG. 2 shows a section through the head part of the pliers in the plane of the pivoting plunger and curved body with the important adjusting components.

Before the pliers is employed by the user, it is pre-adjusted and set in the manufacturer's plant, so that the user only needs to make the adjustment to the desired crimping measurement, thus the crimping depth according to an associated adjustment matrix. The scales shown in FIGS. 2 and 3 for rough and fine adjustments to crimping measurements of 1/100 mm accuracy serve for such adjustments.

Figure 3:
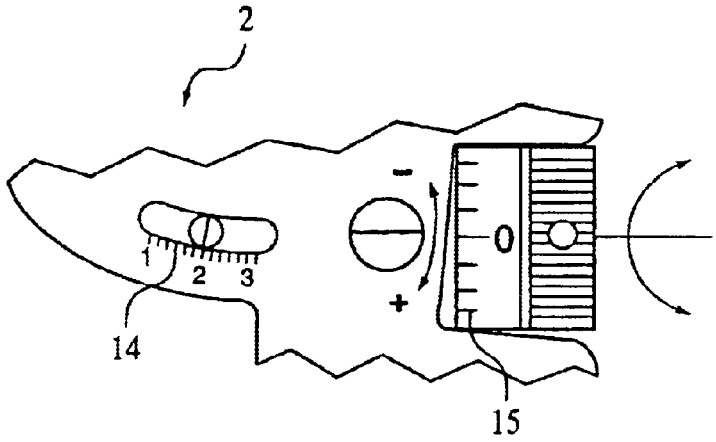
FIG. 3 shows an enlarged part view of the adjusting and setting components according to FIG. 1.

The crimping pliers 1 is pre-adjusted and set and the setting wheel 8 is thus set at the same time as follows:

With the help of a gauge mandrel with a diameter of, for example 2 mm, which has been loosely inserted in the centric crimping opening, the measurement of 2 mm is adjusted with the setting wheel 8 according to scale 14. The setting wheel 8 has to be actuated for this purpose in a delicately sensitive manner. The graduated scale 15 of the set wheel 8 is subsequently set to zero and the pliers is closed (FIG. 3).

With such an adjustment, it still has to be possible to move the gauge mandrel, 2 mm diameter, between the crimping tips of the crimping punches 13 without play. If, for example, this is not immediately possible, the dimensional deviation (+/−) is determined and compensated via the fine adjustment on the graduated scale 15, and after the threaded spindle 7 has been temporarily loosened, the setting wheel 8 is set to zero, and subsequently fixed again in a suitable manner, for example with the help of an index screw.

In deviation from the exemplified embodiment specified above, the adjusting and setting device may be installed also on the movable leg of the pliers, which would not impair its functionality in any way.

A locator, for example 12, usefully may be provided for the crimping pliers as a helpful aid. Such a locator can be rotated by 360° and is capable of receiving, in a manner determining the position, different contact designs depending on their type and size.

The crimping measure and the locator adjustments can be fixed and preset depending on the contact with the help of a matrix designed accordingly.

What is claimed is:

1. A crimping pliers comprising:

(a) a fixed plier leg;

(b) a movable plier leg coupled to said fixed plier leg;

(c) a curved body disposed in a head part of the crimping pliers, said curved body having an arm component extending in a direction parallel to said fixed plier leg and said curved body forming a plurality of control cams;

(d) a pivoting plunger enclosed in said curved body and actuated by said movable plier leg;

(e) a plurality of crimping punches movably disposed in said pivoting plunger; and (f) an adjusting and setting device disposed on said fixed plier leg, comprising:

(i) a threaded bush transversely extending through said arm component;

(ii) a threaded spindle rotatably engaged with said threaded bush;

(iii) a setting wheel secured to said threaded spindle and having a graduated scale for fine adjustments; and (iv) a scale for rough adjustments coupled to said curved body;

wherein said curved body is pivoted in relation to said pivoting plunger by rotating said threaded spindle via said setting wheel thereby displacing said arm component of said curved body; and wherein a pivoting of said curved body adjusts said plurality of control cams permitting a precise adjustment of a work path of said plurality of crimping punches while maintaining a fixed opening angle of the crimping pliers.

2. The crimping pliers according to claim 1, wherein said graduated scale for fine adjustments comprises a division of 0.01 mm and wherein said scale for rough adjustments comprises a division of 0.2 mm.

3. The crimping pliers according to claim 1, further comprising a locator capable of receiving different contact types and sizes for crimping.

* * * * *